US009527116B2

(12) United States Patent
Lomas et al.

(10) Patent No.: US 9,527,116 B2
(45) Date of Patent: Dec. 27, 2016

(54) SYSTEM AND METHOD FOR CONFORMAL CLEANING

(71) Applicant: General Electric Company, Schenectady, NY (US)

(72) Inventors: Jonathan Matthew Lomas, Simpsonville, SC (US); Michelle Fullerton Simpson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 404 days.

(21) Appl. No.: 14/040,671

(22) Filed: Sep. 28, 2013

(65) Prior Publication Data

US 2015/0090303 A1 Apr. 2, 2015

(51) Int. Cl.
*B08B 3/02* (2006.01)
*F01D 25/00* (2006.01)

(52) U.S. Cl.
CPC ..... *B08B 3/02* (2013.01); *F01D 25/002* (2013.01)

(58) Field of Classification Search
CPC ..... F01D 25/002; B08B 3/02
See application file for complete search history.

(56) References Cited

U.S. PATENT DOCUMENTS 5,435,607 A 7/1995 Everett
6,319,098 B1 * 11/2001 Osterheld ..... B24B 37/04 451/444
6,551,422 B1 4/2003 O'Connor
6,905,396 B1 6/2005 Miller et al.
7,186,167 B2 3/2007 Joslin
7,544,112 B1 6/2009 Miller et al.
7,896,726 B1 3/2011 Miller et al.
8,380,338 B2 2/2013 Miller et al.
2007/0119479 A1 * 5/2007 Yoshihara ..... H01L 21/67253 134/18
2008/0011332 A1 * 1/2008 Bailey ..... G01C 25/00 134/56 R
2008/0100809 A1 * 5/2008 Nakashima ..... H01L 21/67253 355/27
2008/0274433 A1 * 11/2008 Takaki ..... G03F 7/3021 430/325
2008/0314870 A1 * 12/2008 Inoue ..... B08B 1/04 216/38
2009/0250079 A1 * 10/2009 Yoshihara ..... B08B 3/024 134/4

(Continued)

FOREIGN PATENT DOCUMENTS

DE 10216285 A1 10/2003
EP 1043079 A1 10/2000

(Continued)

OTHER PUBLICATIONS

European Search Report and Opinion issued in connection with corresponding EP Application No. 14185610.4 on Feb. 26, 2015.

*Primary Examiner* — Michael Barr
*Assistant Examiner* — Benjamin L Osterhout
(74) *Attorney, Agent, or Firm* — Fletcher Yoder, P.C.

(57) ABSTRACT

A system includes a plurality of nozzles, a pump configured to pump a fluid through the nozzles, and a manifold configured to arrange the plurality of nozzles to substantially match a shape of a workpiece. Each nozzle of the plurality of nozzles is configured to impinge upon a section of the workpiece with the fluid.

19 Claims, 2 Drawing Sheets

(56) References Cited

U.S. PATENT DOCUMENTS

| | | | | |
|---|---|---|---|---|
| 2009/0270014 | A1 | 10/2009 | Miller et al. | |
| 2009/0275213 | A1* | 11/2009 | Gotou | H01L 21/02049 438/778 |
| 2010/0003894 | A1 | 1/2010 | Miller et al. | |
| 2010/0029088 | A1* | 2/2010 | Mayer | C23F 1/08 438/748 |
| 2010/0098869 | A1* | 4/2010 | Kinoshita | B05B 12/08 427/421.1 |
| 2010/0132738 | A1* | 6/2010 | Kumar | B08B 3/022 134/10 |
| 2012/0276818 | A1 | 11/2012 | Cramer et al. | |
| 2013/0048015 | A1* | 2/2013 | Mantkowski | C23G 5/00 134/2 |

FOREIGN PATENT DOCUMENTS

| | | | |
|---|---|---|---|
| EP | 1640077 | A2 | 3/2006 |
| EP | 2038088 | | 1/2008 |
| EP | 2123788 | A2 | 11/2009 |
| EP | 2140973 | A1 | 1/2010 |
| EP | 2123788 | A3 | 10/2010 |
| EP | 2140973 | B1 | 10/2012 |
| EP | 2140973 | B8 | 11/2012 |
| SG | 156600 | A1 | 11/2009 |
| SG | 158065 | A1 | 1/2010 |

* cited by examiner

SYSTEM AND METHOD FOR CONFORMAL CLEANING

BACKGROUND

The subject matter disclosed herein relates generally to cleaning systems and, more specifically, to cleaning systems for turbomachinery.

Turbomachinery, such as compressors and turbines, may experience material buildup and/or coating wear over a period of operation. For example, protective coatings may gradually wear and become less effective. By further example, the surface of various components may experience oxidation, corrosion, or material deposits (e.g., due to materials in the fluid flow). In gas turbine engines, the hot combustion gases can wear and/or buildup deposits on surfaces of the turbine blades, nozzles, shrouds, and other components. Unfortunately, the blades and other components have complex geometries, which complicate the cleaning process.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a plurality of nozzles, a pump configured to pump a fluid through the nozzles, and a manifold configured to arrange the plurality of nozzles to substantially match a shape of a workpiece. Each nozzle of the plurality of nozzles is configured to impinge upon a section of the workpiece with the fluid.

In a second embodiment, a method includes holding a workpiece within a manifold having a plurality of nozzles distributed in a pattern substantially conforming to a shape of the workpiece, pumping a fluid through the plurality of nozzles using a pump, and translating at least one of the workpiece, or the manifold, or any combination thereof, with a workpiece holder along an axis to clean the workpiece with the fluid.

In a third embodiment, a system includes a controller having one or more tangible, non-transitory, machine-readable media collectively storing one or more sets of instructions, and one or more processing devices configured to execute the one or more sets of instructions to: control a flow of a fluid through a plurality of nozzles of a manifold. The plurality of nozzles is arranged in a pattern along a perimeter of a workpiece. The instructions also control relative movement between the workpiece and the manifold along an axis to clean the workpiece with the fluid.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

The disclosed embodiments include systems and methods for conformal cleaning and stripping a workpiece using high pressure spray nozzles. Rather than using a multi-axis spray nozzle, the system saves time and reduces costs by simplifying and speeding up the cleaning and stripping process. In certain embodiments, a manifold arranges multiple nozzles around the workpiece so that the workpiece may be cleaned with fewer, or even a single pass. For example, the manifold and nozzles may conform to a shape of the workpiece, such that a substantially uniform distribution of fluid jets from the nozzles impacts the surface of the workpiece. By further example, the manifold and distribution of nozzles may conform to an airfoil shape of a turbine blade, compressor blade, impeller, vane, or the like. In this manner, the manifold and distribution of nozzles may impact fluid jets around an entire perimeter of the workpiece, such that cleaning (i.e., removing and/or stripping deposits and/or coatings) is more uniform or rapid.

Figure 1:
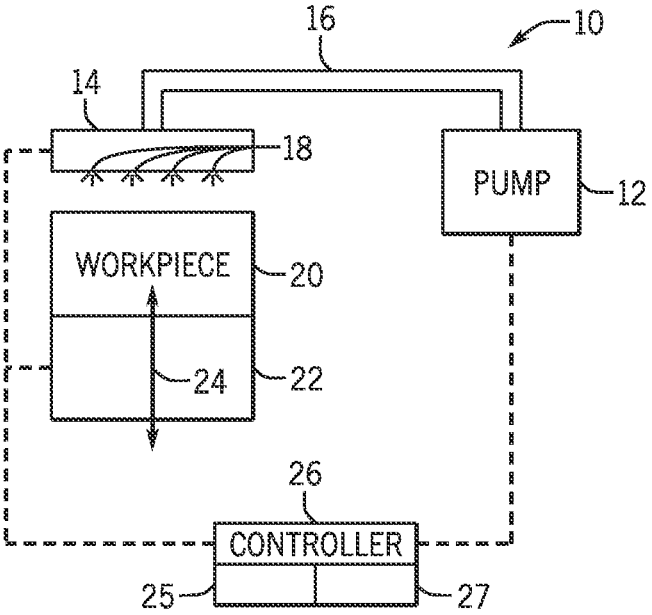
FIG. 1 is a schematic diagram of an embodiment of a workpiece cleaning and stripping system.

FIG. 1 is a schematic diagram of an embodiment of a conformal workpiece cleaning and stripping system 10. The system 10 includes a pump 12 and a manifold 14 connected to the pump 12 by a connection 16 (e.g., conduit). The manifold 14 arranges multiple nozzles 18 (e.g., 2 to 1000) that spray the cleaning/stripping fluid (e.g., liquid, gas, and/or particle laden flow) onto a workpiece 20 (e.g., turbomachinery component, an airfoil, a turbine blade a compressor blade, an impeller, a turbine vane, or a compressor vane). For example, the fluid may include air, water, solvent, stripping chemicals, steam, abrasive particle laden liquid, etc.). The pump 12 may produce pressures in excess of approximately 65,000 kPa, which is enough pressure, for example, to remove a thermal barrier coating from a turbine blade of a gas turbine engine. In other embodiments, the pressure may be between approximately 30,000 kPa and 100,000 kPa, or between approximately 50,000 and 80,000 kPa. The manifold 14, the connection 16, and the nozzles 18 may be configured to be used in conditions where the pressure exceeds 65,000 kPa. For example, the manifold 14 and the nozzles 18 may include high strength metals or reinforced walls for improved durability, and the connection 16 may similarly include hoses or pipes made from durable materials.

The manifold 14 may arrange the nozzles 18 to surround the workpiece 20 in order to clean the exterior surface of the workpiece 20, or may arrange the nozzles 20 to clean an interior surface of the workpiece 20. In other words, the nozzles 18 may be arranged in a pattern that generally conforms to a perimeter (e.g., inner or outer perimeter) of the workpiece 20. The manifold 14 may include any number and spacing of nozzles 18, such as 1, 2, 3, 4, 5, or more nozzles 18 per 1, 2, 3, 4, 5, 6, 7, 8, 9, or 10 centimeters. Depending upon the dimensions of the workpiece 20, the manifold 14 may includes 10, 20, 30, 40, 50, 60, 70, 80, 90, 100, 250, 500, 1000, or more nozzles 18. The workpiece 20 may be any component or tool that fits within the dimensions defined by the manifold 14. The system 10 includes a workpiece holder 22 (e.g., a motorized or hydraulic press) that is configured to translate and/or reciprocate along an axis 24. In the illustrated embodiment, the workpiece holder 22 is shown attached or secured to the workpiece 20. In such a configuration, the manifold 14 is stationary and the workpiece holder 22 translates the workpiece 20 along the axis 24 relative to the manifold 14. In other embodiments, the workpiece holder 22 may be attached to the manifold 14, in which case the workpiece 20 would remain stationary while the manifold 14 translates and/or reciprocates along the axis 24 relative to the workpiece 20. This configuration saves time and expense over single or multi-nozzle spray devices that move along three or more axes and that make multiple passes to remove the coating of the workpiece 20.

The system 10 also includes a controller 26 that monitors and controls various aspects of the system 10 to clean and strip the workpiece 20. The controller 26 monitors and controls aspects of the pump 12 including pressure and power usage, for example. The controller 26 may be programmed to instruct the pump 12 to increase the pressure while the nozzles 18 are directed at certain portions of the workpiece 20, and also decrease the pressure while the nozzles 18 are directed at other portions of the workpiece 20. This may enable the system 10 to clean and strip workpieces 20 that have a coating that varies in thickness or hardness. The controller 26 may also control the manifold 14 including the nozzles 18. The manifold 14 may be configured to provide varying pressures to different nozzles 18 and shut off individual nozzles 18, which functionality may be controlled and monitored by the controller 26. The manifold 14 and controller 26 may also be configured to change the shape of the nozzles 18 before or during operation. For example, the nozzles 18 may begin a cleaning operation in a small circle/dot shape, and later change into a longer slot shape. The controller 26 may also monitor and control the workpiece holder 22 including speed or direction of translation along the axis 24.

The speed or direction of translation may be controlled by the controller 26. The controller 26 may be dedicated entirely to the cleaning and stripping system 10, or the controller 26 may optionally also provide control (or at least some data to facilitate control) for other systems. In the illustrated embodiment, the controller 26 includes a processor 23 and a memory 25. The processor 23 may include a single processor or two or more redundant processors, such as triple redundant processors for control of the cleaning and stripping system 10. The memory 25 may include volatile and/or non-volatile memory. For example, the memory 25 may include one or more hard drives, flash memory, read-only memory, random access memory, or any combination thereof. In one embodiment, the controller 26 may include one or more tangible, non-transitory, machine-readable media (e.g., the memory 25) collectively storing one or more sets of instructions and one or more processing devices (e.g., the processor 23) configured to execute the one or more sets of instructions. The controls may include software and/or hardware controls. For example, the controls may include various instructions or code stored on the memory 25 and executable by the processor 23. The instructions may control the rate that the workpiece 20 translates and/or reciprocates relative to the manifold 14, or may control the pressure of the nozzles 18, an angle of the nozzles 18, a speed or angle of oscillation of the workpiece 20 relative to the manifold 14, and/or other operations of the cleaning system 10. The instructions may be based on characteristics of the workpiece 20 (e.g., model, whether workpiece 20 is the first stage turbine blades, second stage turbine blades, first stator blades) or on the machine that the workpiece 20 was being used in (e.g., the type of machine, time since last cleaning, coating material used, etc.). The characteristics may make up a profile or a conditions arrangement.

Figure 2:
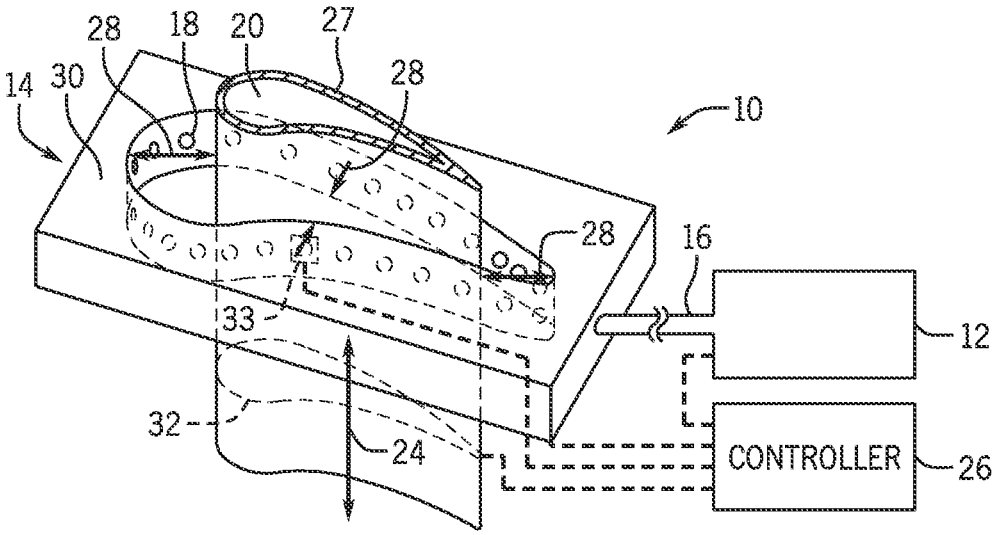
FIG. 2 is a perspective view of an embodiment of a conformal cleaning system including a manifold.

FIG. 2 is a perspective view of an embodiment of the conformal cleaning system 10 including the manifold 14. The system 10 includes the pump 12 and the connection 16 delivering a pressure (e.g., up to or in excess of approximately 65,000 kPa) to the manifold 14 in order to clean or strip the workpiece 20 (e.g., turbomachinery component). The system 10 includes a manifold that conforms (i.e., matches or substantially surrounds) the workpiece 20. The illustrated system 10 demonstrates that the manifold 14 may be configured to match to the shape of the workpiece 20 to clean the workpiece 20 or strip and remove a coating 27. In other embodiments, the manifold 14 may be configured to only partially match the shape of the workpiece 20. For example, the airfoil shaped workpiece 20 illustrated in FIG. 2 may be surrounded by a round manifold 14, or substantially surrounded by a C-shaped manifold 14 as well. Substantially surround, in the context of this application means that the manifold 14 surrounds most, but not necessarily all, of the circumference of the workpiece 20 in order to clean the workpiece 20 or remove the coating 27. This also applies to an interior circumference as explained below with regard to FIG. 4.

The coating 27 may include multiple layers, such as a thermal barrier coating (TBC) with a ceramic layer for use in high temperature conditions and an adhesive layer to attach the TBC to the substrate of the workpiece 20. The coating 27 may also include layers of carbon deposits or other contaminants, such as deposits from hot combustion gases. The cleaning system 10 may also be used to remove residue stains, spots, or other surface degradation associated with oxidation, corrosion, erosion, rust, or the like. The manifold 14 and distribution of nozzles 18 may substantially surround, match, or conform to the shape of the workpiece 20 by extending substantially around a perimeter of the workpiece 20 at a distance 28 that is within a range away from the workpiece 20. The distance 28 may be configured to balance a spread of the fluid from the nozzles 18 and the resultant drop in pressure. The distance 28 may thus be 1, 2, 3, 4, 5, 6, 7, 8, 9, 10, or more centimeters. The range may be defined as the difference between the minimum distance 28 and the maximum distance 28 of the manifold 14 and/or distribution of nozzles 18 relative to the perimeter (e.g., inner or outer perimeter) of the workpiece 20. For example, the manifold 14 and distribution of nozzles 18 may surround all or a portion of the workpiece 20 (e.g., in one or more planes crosswise or perpendicular to the axis 24), so that each nozzle 18 is approximately 3 to 4 cm away from the perimeter of the workpiece 20 (e.g., a range of approximately 1 cm). The range may be less than or equal to approximately 5 cm, 4 cm, 3 cm, 2 cm, 1 cm, 0.5 cm, or less. In some embodiments, the manifold 14 and distribution nozzles 18 may be the same distance 28 away from the workpiece 20 around the entire perimeter of the workpiece 20 (e.g., a range of approximately zero).

As illustrated, the nozzles 18 have an airfoil shaped distribution 19 along an airfoil shaped opening 15 in the manifold 14. The airfoil shapes 15, 19 may correspond to an airfoil shape of a turbine or compressor blade, for example. In other embodiments, the distance 28 may be different for different parts surrounding the workpiece 20. Also, each nozzle 18 may be adjustable such that for one workpiece 20 the manifold 14 may have one shape, while for a different workpiece 20, the same manifold 14 may have a different shape due to adjustment of some of the nozzles 18 within that manifold 14. As illustrated, the nozzles 18 are installed on the manifold 14 pointing directly at the workpiece 20. In other embodiments, the nozzles 18 may include a subset of nozzles 18 that each impinge upon the workpiece 20 at a different angle. For example, while one nozzle 18 may point directly along a normal of the workpiece 20, the adjacent nozzle 18 may point at an angle 10 degrees, or 15 degrees from the normal of the workpiece 20.

The manifold 14 may include a plenum 30 configured to provide substantially equal pressure to the nozzles 18. For example, the plenum 30 may include a hollow space inside the manifold 14 with a cross-sectional area that is significantly greater than the area of the nozzle 18. The pump 12 pressurizes a stripping fluid, such as water or water with abrasive material like sand or garnet added, which is then conveyed to the plenum 30 via the connection 16. The plenum 30 receives the stripping fluid into the plenum chamber and equalizes the pressure for even distribution through the nozzles 18.

In some embodiments, the workpiece 20 may not be the same cross-sectional shape 32 along the length of the translation axis 24. In this instance, the manifold 14 is configured to maintain an average distance from the workpiece 20 and other factors may be controlled to equalize stripping so that some areas of the workpiece do not get stripped more than others. For example, the controller 26 may control a flow control valve 33 for one or more nozzles 18 in order to change the shape of the nozzles 18 and/or the spray pattern. The flow control valve 33 may also change the pressure of each individual nozzle 18, or create a frequency (e.g., pulsating flow at frequency) in which the nozzle 18 is alternately spraying and not spraying. The frequency may change on a per-nozzle 18 basis or the controller 26 may control all the nozzles 18 at once to maintain the same frequency. As an adjustment for various shapes of workpieces 20, the manifold 14 may also be configured to arrange the nozzles 18 closer to or further apart from one another. This may provide more stripping fluid pressure to some areas of the workpiece 20 than to others. In these ways the controller 26 may control cleaning of the workpiece and/or the amount of the coating 27 that is removed from the workpiece 20 as it is translated along the axis 24 through the entire length of the workpiece 20. The controller 26 may also adjust (e.g., increase or decrease) the speed of the workpiece holder 22, pressure from the pump, fluid composition, (e.g., amount of abrasive material), distance of nozzles 18, angle of nozzles 18, opening size of nozzles 18, or any combination thereof.

Figure 3:
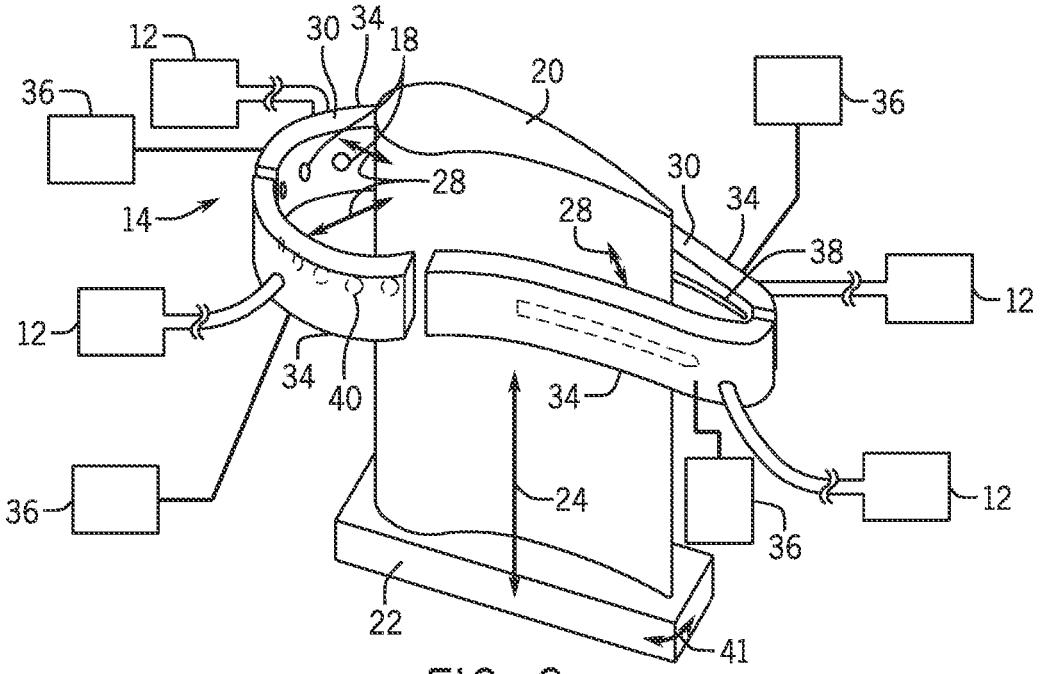
FIG. 3 is a perspective view of an embodiment of a conformal cleaning system including several nozzle subsets.

FIG. 3 is a perspective view of an embodiment of the conformal cleaning system 10 including several nozzle subsets 34 (e.g, manifold 14 portions with nozzles). Each of the subsets 34 may include the plenum 30 and nozzles 18. The system 10 with multiple subsets 34 may be more adaptable to various shapes of workpieces 20. That is, if the system 10 is used to clean and strip a variety of workpieces 20 with a variety of shapes, it may be useful to have the system 10 be adaptable. The subsets 34 of nozzles 18 may be more mobile and changeable than a manifold 14 with a single shape. Each subset 34 may include a pump 12 and a connection 16 (e.g., conduit). Additionally, each subset 34 may include an exclusive set of nozzles 18 and a driver 36 that is able to change the distance 28 of the subset 34 in relation to the workpiece 20. Each driver 36 may include a motorized actuator, a hydraulic actuator, a pneumatic actuator, or any combination thereof. Thus, during a cleaning or stripping operation, each driver 36 may move each subset 34 individually to increase, decrease, or maintain the distance 28 from the workpiece 20 based on the shape of the workpiece 20. The subsets 34 may include as few as one nozzle 18 and as many as 10, 20, 30, 40, or 50 or more nozzles 18.

The nozzles 18 may also include a variety of shapes that may or may not change during operation. For example, the illustrated nozzles 18 include a slot-type nozzle 18 and a dot or round nozzle 40. Other shapes may include triangle, square, pentagonal, or other shapes. Different shapes of nozzles 18 may enable the system 10 to employ a variety of spray patterns that facilitate stripping or cleaning of a variety of surface constitutions and contours. Additionally, in order to clean and strip the area of the workpiece 20 that aligns with a section that is between nozzles 18, the workpiece holder 22 may oscillate the workpiece 20 circumferentially 41 around the axis of translation 24. The oscillations may be in a limited range of degrees (e.g., 15, 10, 5, or fewer degrees) so that the shape of the manifold 14 still substantially matches or conforms to the shape 32 of the workpiece 20 as the workpiece 20 or the manifold 14 is translated along the axis 24. In some embodiments where the workpiece 20 is substantially circular or round, the workpiece holder 22 may oscillate completely 360 degrees.

Figure 4:
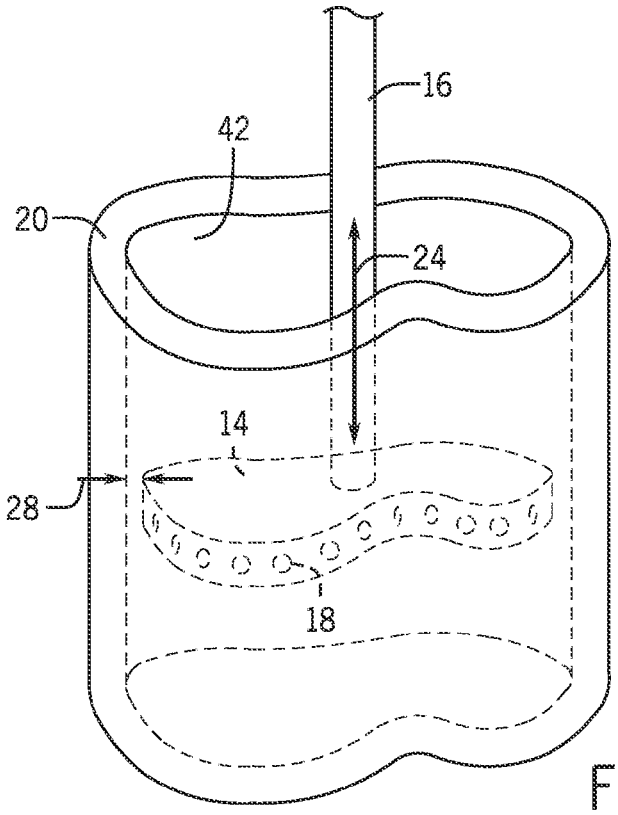
FIG. 4 is a perspective view of an embodiment of a conformal cleaning system including a manifold configured to point nozzles outward.

FIG. 4 is a perspective view of an embodiment of the conformal cleaning system 10 including the manifold 14 configured to point nozzles 18 outward. In the illustrated embodiment, the workpiece 20 includes an interior surface 42 that is contoured. The manifold 14 is connected to the pump 12 via the connection 16. The manifold 14 arranges the nozzles 18 as in the embodiments described with regard to the previous figures. In the illustrated embodiment of FIG. 4, however, the nozzles 18 impinge outward from the manifold 14 instead of inward. The manifold 14 may be configured to maintain a range of distance 28 between the nozzles 18 and the workpiece 20. The manifold 14 in FIG. 4 may also contain subsets of nozzles 18 as illustrated in FIG. 3. The subsets of nozzles 18 incorporated into the interior of a workpiece 20 may also be shifted closer to and away from the workpiece 20 using the driver 36, as was described with respect to FIG. 3.

Technical effects of the disclosed embodiments include conformal cleaning and stripping systems 10 that include the manifold 14 to arrange nozzles 18 to substantially match the shapes of workpieces 20. The nozzles 18 spray stripping fluid, such as water or mixture of water and abrasive material. The manifold 14 with the nozzles 18 moves along the axis 24 relative to the workpiece 20. Specifically, in some embodiments, the workpiece 20 is connected to the workpiece holder 22 which moves the workpiece 20 along the axis 24. In other embodiments, the workpiece holder 22 may be connected with the manifold 14 such that the manifold 14 translates along the axis 24 while the workpiece 20 remains stationary. Some embodiments may include the plenum 30, which provides substantially equal pressure to the nozzles 18 of the manifold 14. The pressure may be provided by the pump 12, or more than one pump 12, all of which pressurize the stripping fluid to pressures that may exceed approximately 30,000, 50,000, 65,000, 80,000, or 100,000 kPa. Other pressures may be used as well depending on the component and coatings.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a plurality of nozzles;

a pump configured to pump a fluid through the plurality of nozzles;

a manifold comprising an arrangement of the plurality of nozzles, wherein the arrangement of the plurality of nozzles at least partially conform conforms to a curvature of a turbomachine component, wherein each nozzle of the plurality of nozzles is configured to impinge upon a section of the turbomachine component with the fluid; and a workpiece holder configured to move the turbomachine component workpiece or the manifold along an axis.

2. The system of claim 1, wherein the workpiece holder is configured to oscillate the turbomachine component workpiece or the manifold circumferentially around the axis.

3. The system of claim 1, wherein each nozzle in a subset of nozzles in the plurality of nozzles is configured to impinge upon the turbomachine component workpiece at a different angle relative to a normal of the turbomachine component workpiece.

4. The system of claim 1, wherein the pump is configured to pump the fluid at a pressure greater than approximately 65,000 kPa.

5. The system of claim 1, comprising a plenum configured to provide substantially equal pressure of stripping fluid to each nozzle of the plurality of nozzles.

6. The system of claim 1, wherein the pump comprises a plurality of pumps.

7. The system of claim 6, wherein each pump of the plurality of pumps is configured to provide pressure to a subset of the plurality of nozzles, and each nozzle of the plurality of nozzles is included in only one subset.

8. The system of claim 6, wherein each pump of the plurality of pumps is configured to be independently adjusted by a controller.

9. The system of claim 1, wherein the manifold is configured to arrange the plurality of nozzles to impinge outwardly against the turbomachine component.

10. The system of claim 1, wherein the arrangement of the plurality of nozzles extends at least partially around the curvature of the turbomachine component.

11. The system of claim 10, wherein the manifold and/or the plurality of nozzles has an airfoil shaped configuration to correspond to an airfoil shape of the turbomachine component.

12. The system of claim 1, comprising a controller, comprising:

one or more tangible, non-transitory, machine-readable media collectively storing one or more sets of instructions; and one or more processing devices configured to execute the one or more sets of instructions to:

control a flow of a fluid through an arrangement of a plurality of nozzles of a manifold, wherein the arrangement of the plurality of nozzles at least partially conforms to a curvature of a turbomachine component; and control relative movement between the turbomachine component and the manifold along an axis to clean the turbomachine component with the fluid.

13. A method, comprising:

arranging a plurality of nozzles within a manifold in a pattern at least partially conforming to a curvature shape of a turbomachine component;

pumping a fluid through the plurality of nozzles using a pump;

controlling a relative movement between the turbomachine component workpiece and the manifold along an axis to clean the turbomachine component workpiece with the fluid;

holding the turbomachine component within the manifold; and translating at least one of the turbomachine component or the manifold, or any combination thereof, with a workpiece holder along the axis to clean the turbomachine component with the fluid.

14. The method of claim 13, comprising oscillating the workpiece holder circumferentially around the axis while translating at least one of the turbomachine component workpiece, or the manifold, or any combination thereof along the axis.

15. The method of claim 13, wherein the turbomachine component comprises an airfoil, a turbine blade a compressor blade, an impeller, a turbine vane, or a compressor vane.

16. A system, comprising:

a controller, comprising:

one or more tangible, non-transitory, machine-readable media collectively storing one or more sets of instructions; and one or more processing devices configured to execute the one or more sets of instructions to:

control a flow of a fluid through an arrangement of a plurality of nozzles of a manifold, wherein the arrangement of the plurality of nozzles at least partially conforms to a curvature of a turbomachine component workpiece; and control relative movement between the turbomachine component workpiece and the manifold along an axis to clean the turbomachine component with the fluid through the use of a workpiece holder.

17. The system of claim 16, wherein the controller comprises a plurality of cleaning profiles that are different from one another.

18. The system of claim 16, wherein the controller comprises an airfoil cleaning profile, a turbine blade cleaning profile, a compressor blade cleaning profile, an impeller cleaning profile, a turbine vane cleaning profile, a compressor vane cleaning profile, or any combination thereof.

19. The system of claim 16, wherein the controller comprises a surface cleaning profile, a coating stripping profile, or a combination thereof.

* * * * *